US009336940B2

(12) United States Patent
Park et al.

(10) Patent No.: US 9,336,940 B2
(45) Date of Patent: May 10, 2016

(54) LAMINATED INDUCTOR AND ARRAY THEREOF

(71) Applicant: SAMSUNG ELECTRO-MECHANICS CO., LTD., Suwon, Gyunggi-do (KR)

(72) Inventors: Heung Kil Park, Gyunggi-do (KR); Min Cheol Park, Gyunggi-do (KR)

(73) Assignee: Samsung Electro-Mechanics Co., Ltd., Suwon, Gyunggi-do (KR)

( * ) Notice: Subject to any disclaimer, the term of this patent is extended or adjusted under 35 U.S.C. 154(b) by 67 days.

(21) Appl. No.: 13/960,117

(22) Filed: Aug. 6, 2013

(65) Prior Publication Data

US 2014/0266538 A1 Sep. 18, 2014

(30) Foreign Application Priority Data

Mar. 14, 2013 (KR) ..... 10-2013-0027535

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 17/00*** | (2006.01) |

(52) U.S. Cl.
CPC ..... *H01F 27/29* (2013.01); *H01F 17/0013* (2013.01)

(58) Field of Classification Search
CPC ..... H01F 5/00; H01F 27/28
USPC ..... 336/200, 232
See application file for complete search history.

(56) References Cited

U.S. PATENT DOCUMENTS

| | | | | |
|---|---|---|---|---|
| 5,970,604 | A * | 10/1999 | Person et al. | 29/609 |
| 6,452,473 | B1 * | 9/2002 | Suzuki et al. | 336/223 |
| 2003/0030510 | A1 * | 2/2003 | Sasaki et al. | 333/185 |

FOREIGN PATENT DOCUMENTS

| | | | |
|---|---|---|---|
| JP | 2002111421 | A * | 4/2002 |
| JP | 2011061760 | A * | 3/2011 |
| KR | 1996-0039026 | A | 11/1996 |
| KR | 10-0142242 | B1 | 3/1998 |

* cited by examiner

*Primary Examiner* — Tsz Chan
(74) *Attorney, Agent, or Firm* — McDermott Will & Emery LLP

(57) ABSTRACT

There is provided a laminated inductor including: a body having a plurality of sheets laminated in a width direction, and having first and second main surfaces in a thickness direction, third and fourth end surfaces in a length direction, and fifth and sixth side surfaces in the width direction; a first connection electrode formed on the first main surface of the body; first and second terminal electrodes formed on the second main surface of the body to be spaced apart from one another; a plurality of first internal conductive patterns connecting the first connection electrode and the first terminal electrode; and at least one or more second internal conductive patterns connecting the first connection electrode and the second terminal electrode.

9 Claims, 8 Drawing Sheets

LAMINATED INDUCTOR AND ARRAY THEREOF

CROSS-REFERENCE TO RELATED APPLICATIONS

This application claims the priority of Korean Patent Application No. 10-2013-0027535 filed on Mar. 14, 2013, in the Korean Intellectual Property Office, the disclosure of which is incorporated herein by reference.

BACKGROUND OF THE INVENTION

1. Field of the Invention

The present invention relates to a laminated inductor and an array thereof.

2. Description of the Related Art

Recently, as cloud computing infrastructure has been implemented and smartphones, tablet PCs, and the like have emerged, the market for small portable communications terminals has grown rapidly.

Particularly, in the case of portable communications terminals, market competition, manifested in product multi-functionalization and miniaturization/thinness, is becoming fierce. In this situation, wireless communications circuits are required to be modularized, such that multi-band communications and reductions in wireless communication circuit volumes are required in connection therewith.

In addition, a portable communications terminal has highly improved processing capabilities in a central processing unit (CPU) provided in a base band unit to enable driving in a relatively high frequency region, such that a wireless module and a radio frequency (RF) analog circuit are also subjected to electromagnetic wave interference of peripheral circuits. As a result, an environment in which communications problems easily occur has been created.

An example of an effective part serving as a trap filter in the above-mentioned high frequency region includes an inductor.

The inductor may prevent a high frequency of a transmission signal of the base band unit from being overlapped with a RF analog signal such as a carrier to thereby efficiently cope with electromagnetic compatibility (EMC) within a device.

This inductor may be classified as a coil-type inductor, a laminated-type inductor, a thin-type inductor, or the like, according to a structure thereof.

Among these, the laminated inductor may be generally formed to have a structure including a body in which a plurality of magnetic layers or non-magnetic layers having internal conductive patterns formed therein are laminated in a horizontal direction, a pair of terminal electrodes disposed on external surfaces of the body, and a pair of external connection conductors disposed on the external surfaces of the body to oppose one another, having the body therebetween.

However, in the laminated inductor according to the related art, stray capacitance may be easily generated between printed circuit boards (PCBs) such that high frequency characteristics of the laminated inductor may be easily degraded, and noise generated at high frequencies may not be easily removed.

In addition, contact between the pair of terminal electrodes and the pair of external connection conductors, a solder bridge or the like, at the time of mounting the inductor may be generated, such that it may be difficult to miniaturize the laminated inductor.

While the following Patent Document 1 discloses a laminated inductor having a structure in which external connection conductors are formed on both sides of a body and, in addition, Patent Document 1 does not disclose a structure in which magnetic layers or non-magnetic layers are laminated in a width direction.

RELATED ART DOCUMENT (Patent Document 1) Korean Patent Laid-Open Publication No. 10-1996-0039026

SUMMARY OF THE INVENTION

An aspect of the present invention provides a laminated inductor capable of having a high self-resonance frequency and efficiently removing noise generated at a high frequency by decreasing stray capacitance.

According to an aspect of the present invention, there is provided a laminated inductor including: a body having a plurality of sheets laminated in a width direction, and having first and second main surfaces opposing one another in a thickness direction, third and fourth end surfaces opposing one another in a length direction, and fifth and sixth side surfaces opposing one another in the width direction; a first connection electrode formed on the first main surface of the body; first and second terminal electrodes formed on the second main surface of the body to be spaced apart from one another; a plurality of first internal conductive patterns formed on respective sheets laminated within the body and connecting the first connection electrode and the first terminal electrode; and at least one or more second internal conductive patterns formed on respective sheets laminated within the body and connecting the first connection electrode and the second terminal electrode.

The laminated inductor may further include a second connection electrode formed on the first main surface of the body to be spaced apart from the first connection electrode; and at least one or more third internal conductive patterns formed on respective sheets laminated within the body and connecting the second connection electrode and the first terminal electrode.

According to another aspect of the present invention, there is provided a laminated inductor including: a body having a plurality of sheets laminated in a width direction, and having first and second main surfaces opposing one another in a thickness direction, third and fourth end surfaces opposing one another in a length direction, and fifth and sixth side surfaces opposing one another in the width direction; a first connection electrode extended from the first main surface of the body to the third end surface thereof; a first terminal electrode extended from the second main surface of the body to the third end surface thereof; a second terminal electrode spaced apart from the first terminal electrode and extended from the second main surface of the body to the fourth end surface thereof; a plurality of first internal conductive patterns formed on respective sheets laminated within the body and connecting the first connection electrode and the first terminal electrode; and at least one or more second internal conductive patterns formed on respective sheets laminated within the body and connecting the first connection electrode and the second terminal electrode.

The laminated inductor may further include a second connection electrode spaced apart from the first connection electrode and extended from the first main surface of the body to the fourth end surface thereof; and at least one or more third internal conductive patterns formed on respective sheets laminated within the body and connecting the second connection electrode and the first terminal electrode.

According to another aspect of the present invention, there is provided a laminated inductor array, including: a body having a plurality of sheets laminated in a width direction, and having first and second main surfaces opposing one another in a thickness direction, third and fourth end surfaces opposing one another in a length direction, and fifth and sixth side surfaces opposing one another in the width direction; a plurality of first connection electrodes spaced apart from one another and extended from the first main surface of the body to the third end surface thereof; a plurality of second connection electrodes formed to be spaced apart from one another and formed from the first main surface of the body to the fourth end surface thereof; a plurality of first terminal electrodes formed from the second main surface of the body to the third end surface thereof and formed to be spaced apart from one another; a plurality of second terminal electrodes formed from the second main surface of the body to the fourth end surface thereof and formed to be spaced apart from one another; a plurality of first internal conductive patterns formed on sheets laminated within the body and connecting the first connection electrode and the first terminal electrode; at least one second internal conductive pattern formed on sheets laminated within the body and connecting the first connection electrode and the second terminal electrode; and at least one third internal conductive pattern formed on sheets laminated within the body and connecting the second connection electrode and the first terminal electrode.

The first and second terminal electrodes and the first and second connection electrodes may be disposed to face one another in the thickness direction of the body.

The first internal conductive pattern may be formed to be extended along sides of the sheet so as to be adjacent to the first and second main surfaces and the fourth end surface of the body.

The second internal conductive pattern may be formed to be extended along sides of the sheet so as to be adjacent to the second main surface and the third end surface of the body, and the third internal conductive pattern may be formed to be extended along sides of the sheet so as to be adjacent to the first main surface and the third end surface of the body.

The first and second internal conductive patterns may have a constant width over the entire length thereof.

A direct current resistance $R_{DC}$ value and an equivalent series resistance (ESR) value may be controlled according to width, thickness, and amount of the second internal conductive patterns.

The sheets may be formed of a magnetic material or a non-magnetic material.

The first to third internal conductive patterns may be formed on the sheets by adjusting widths and positions of the respective patterns so as not to allow overlap area portions therebetween to be overlapped with one another.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
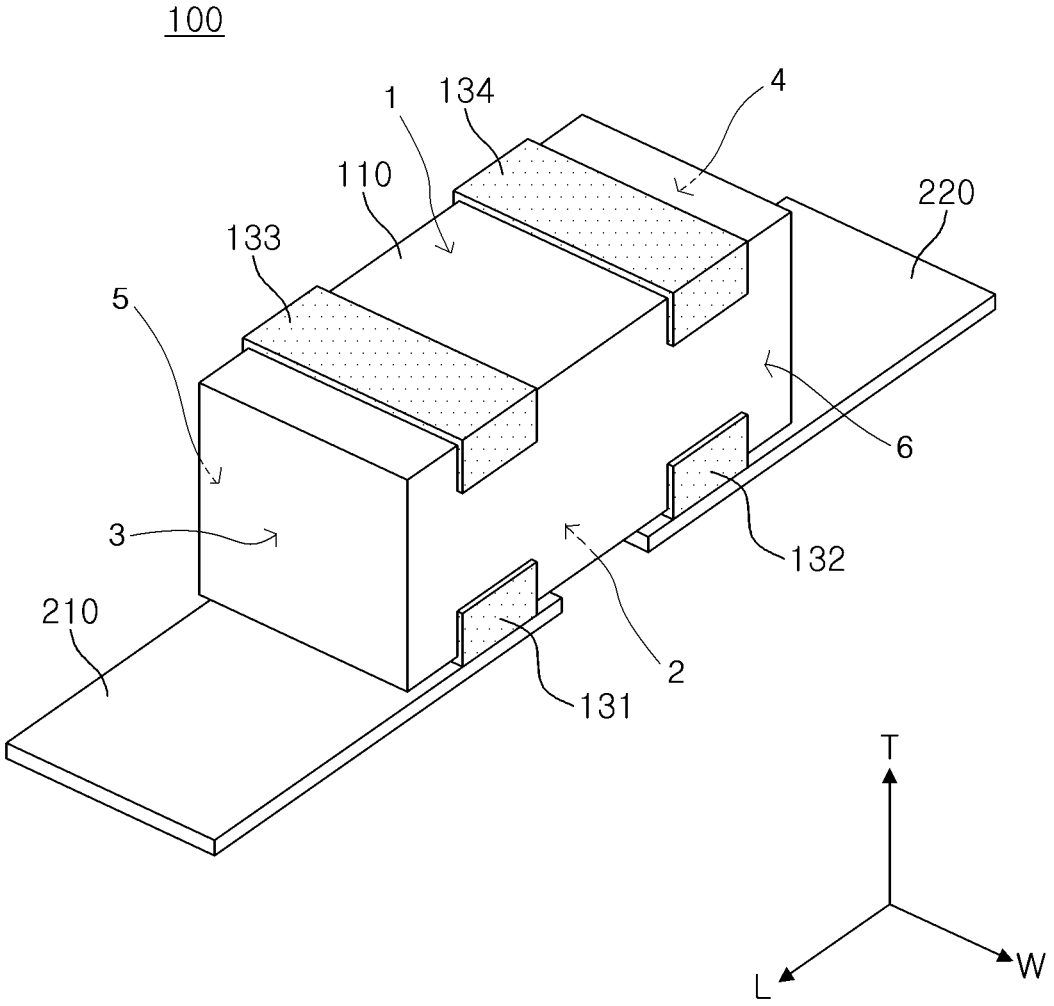
FIG. 1 is a perspective view showing a laminated inductor and a printed circuit board (PCB) according to an embodiment of the present invention.

Hereinafter, embodiments of the present invention will be described in detail with reference to the accompanying drawings.

The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In the drawings, the shapes and dimensions of elements may be exaggerated for clarity, and the same reference numerals will be used throughout to designate the same or like elements.

Laminated Inductor

Referring to FIGS. 1 and 2, a laminated inductor 100 according to an embodiment of the invention includes a body 110 having a rectangular parallelepiped shape, a first connection electrode 133 formed on an upper surface of the body 110, and first and second terminal electrodes 131 and 132 formed on a lower surface of the body 110 to be spaced apart from one another.

In the embodiment of the invention, the body 110 may be formed by laminating a plurality of sheets in a width direction and then sintering the same. Adjacent sheets may be integrated such that boundaries therebetween one another may not be readily apparent. The sheets according to the embodiment of the invention may be formed of various dielectric materials, for example, a magnetic material such as a ferrite or the like, a non-magnetic material such as ceramic or the like, as needed. Hereinafter, in the embodiment of the invention, a magnetic layer is used for convenience of explanation, but the invention is not limited thereto.

Directions of the body 110, formed as a hexahedron, will be defined in order to clearly describe the embodiments of the invention. 'L,' 'W' and 'T' in FIG. 1 refer to a length direction, a width direction, and a thickness direction, respectively. Here, the width direction may be identical to a direction in which the magnetic layers are laminated.

In addition, in the embodiment of the invention, surfaces of the body 110 opposing one another in the thickness direction are defined as first and second main surfaces 1 and 2, surfaces of the body 110 connecting the first and second main surfaces 1 and 2 and opposing one another in the length direction are defined as third and fourth end surfaces 3 and 4, and surfaces of the body 110 opposing one another in the width direction are defined as fifth and sixth side surfaces 5 and 6, for convenience of explanation.

The first main surface 1 of the body 110 may be provided with a second connection electrode 134 in a position spaced apart from the first connection electrode 133, as needed.

The second connection electrode 134 allows for no specific orientation with respect to mounting of the body 110 in upward and downward directions, and thus, it may solve a problem in which the body 110 is unable to be operated in the case in which the body 110 has reversed in upward and downward directions when mounted on the PCB, or the like.

In addition, the first and second terminal electrodes 131 and 132 and the first and second connection electrodes 133 and 134 may be formed to face one another in the thickness direction of the body 110. This is intended to more effectively arrange and print internal conductive patterns to be described below and a detailed description thereof will be provided in the following corresponding part.

The body 110 may be formed by laminating a plurality of magnetic layers 111 in a vertical direction. In this case, the magnetic layer 111 may use, for example, Ni—Cu—Zn based ferrite, Ni—Cu based ferrite or Mn—Cu based ferrite, but is not limited thereto.

The first and second terminal electrodes 131 and 132 formed on the second main surface 2 of the body 110 to be spaced apart from one another may serve to electrically connect the laminated inductor 100 to an external circuit (not shown) formed on circuit substrates 210 and 220 in the case in which the laminated inductor 100 is mounted on the circuit substrates 210 and 220 such as the PCB.

On the other hand, the first and second connection electrodes 133 and 134 formed on the first main surface of the body 110 serve to connect the first to third internal conductive patterns to one another. As a result, the need of a via, according to the related art, may be removed.

That is, when the laminated inductor 100 is mounted on the circuit substrates 210 and 220, the first and second connection electrodes 133 and 134 are not directly connected to the external circuit on the circuit substrates 210 and 220.

Meanwhile, when the body 110 is mounted in a state in which the upward and downward directions thereof are reversed as compared to those shown in FIG. 1, the first and second terminal electrodes 131 and 132 serve as the first and second connection terminals in the case of mounting in a forward direction on FIG. 1 and the first and second connection electrodes 133 and 134 serve as the first and second terminal electrodes in the case of mounting in the forward direction on FIG. 1.

That is, according to the embodiment of the invention, no specific orientation is provided with respect to the mounting of the body 110 in the upward and downward directions by allowing two terminal electrodes 131 and 132 and two connection electrodes 133 and 134 to face one another in the thickness direction, such that the problem in which the body 110 is unable to be operated may be solved even in the case in which the body 110 is reversely mounted in the upward and downward directions as compared to the case shown in FIG. 1.

Hereinafter, a structure of the laminated inductor according to the embodiment of the invention will be described based on the state of the body 110 disposed in a forward direction as shown in FIGS. 1 and 2 for convenience of explanation.

The first to third internal conductive patterns 121, 122 and 123 may be formed on the magnetic layers 111 within the body 110.

In addition, the first to third internal conductive patterns 121, 122 and 123 may have a constant width over the entire length thereof.

The above-mentioned first to third internal conductive patterns 121, 122 and 123 may be electrically connected to the first and second terminal electrodes 131 and 132 and the first and second connection electrodes 133 and 134, through drawn-out portions protruded toward upper and lower sides of the magnetic layer 111 from both ends of the first to third internal conductive patterns 121, 122 and 123.

Here, the first internal conductive pattern 121 may be configured to connect the first connection electrode 133 and the first terminal electrode 131, the second internal conductive pattern 122 may be configured to connect the first connection electrode 133 and the second terminal electrode 132, and the third internal conductive pattern 123 may be configured to connect the second connection electrode 134 and the first terminal electrode 131.

Figure 2A:
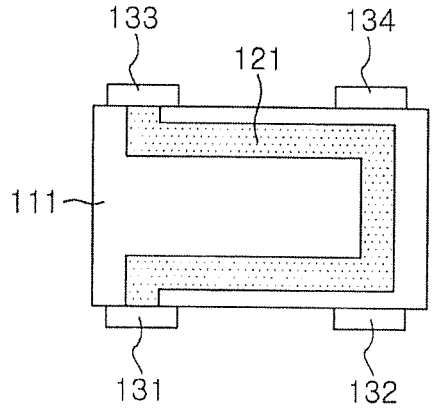
FIGS. 2A through 2C are plan views showing first to third internal conductive patterns of the laminated inductor according to the embodiment of the present invention.

In this case, the first internal conductive pattern 121 may be formed to be extended along the upper and lower sides and a right side of the magnetic layer 111 on FIG. 2A so as to be adjacent to the first and second main surfaces 1 and 2 and the fourth end surface 4 of the body 110 so that the internal conductive pattern 121 is elongated.

That is, as shown in FIG. 2A, the first internal conductive pattern 121 may be formed to have a "⊃" shape adjacent to the upper and lower sides and the right side of the magnetic layer 111, and both ends of the first internal conductive pattern 121 are bent in a vertical direction to be drawn out through the upper and lower sides of the magnetic layer 111, such that they may be electrically connected to the first connection electrode 133 and the first terminal electrode 131 formed on the body 110, respectively.

Figure 2B:
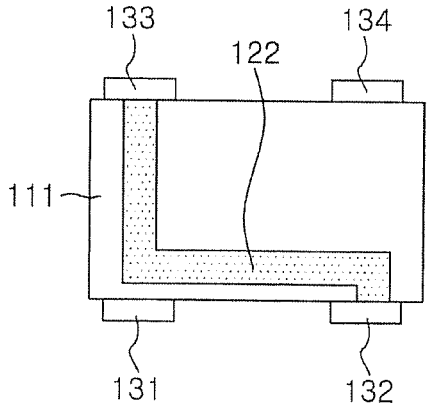

In addition, the second internal conductive pattern 122 may be formed to be extended along the lower side and a left side of the magnetic layer 111 on FIG. 2B so as to be adjacent to the second main surface 2 and the third end surface 3 of the body 110 so that the internal conductive pattern 122 is elongated.

That is, the second internal conductive pattern 122 may be formed to have a "∟" shape adjacent to the lower side and the left side of the magnetic layer 111, and an upper end thereof may be electrically connected to the first connection electrode 133 by being drawn out through the upper side of the magnetic layer 111, and a lower end thereof may be electrically connected to the second terminal electrode 132 by being bent toward the lower side of the magnetic layer 111 to be drawn out through the lower side of the magnetic layer 111.

Figure 2C:
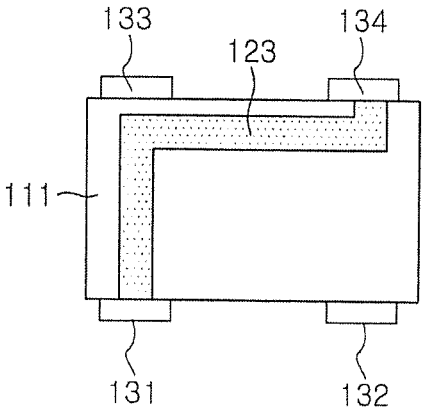

In addition, the third internal conductive pattern 123 may be formed to be extended along the upper side and the left side of the magnetic layer 111 on FIG. 2C so as to be adjacent to the first main surface 1 and the third end surface 3 of the body 110 so that the internal conductive pattern 123 is elongated.

That is, the third internal conductive pattern 123 may be formed to have a "⌜" shape adjacent to the upper side and the left side of the magnetic layer 111, and an upper end thereof may be electrically connected to the second connection electrode 134 by being bent toward the upper side of the magnetic layer 111, and a lower end thereof may be electrically connected to the first terminal electrode 131 by being drawn out through the lower side of the magnetic layer 111.

As described above, the first internal conductive pattern 121 is connected to the first connection electrode 133 and the first terminal electrode 131 and the second internal conductive pattern 122 is connected to the first connection electrode 133 and the second terminal electrode 132, and thus, the respective internal conductive patterns may be formed to have a coil structure and may be electrically connected to the circuit substrates 210 and 220.

In the above-described structure of the laminated inductor 100, the internal conductive patterns may be easily connected to one another to thereby form a coil structure without using existing vias.

Therefore, several problems in via processing and via characteristics generated due to the use of vias, for example, limitation in increasing a loop size, erroneous via connection, resistance increasing due to unevenness portions on an internal wall surface of the via, contamination due to dust generated at the time of punching a via hole, and the like may be prevented.

Figure 3:
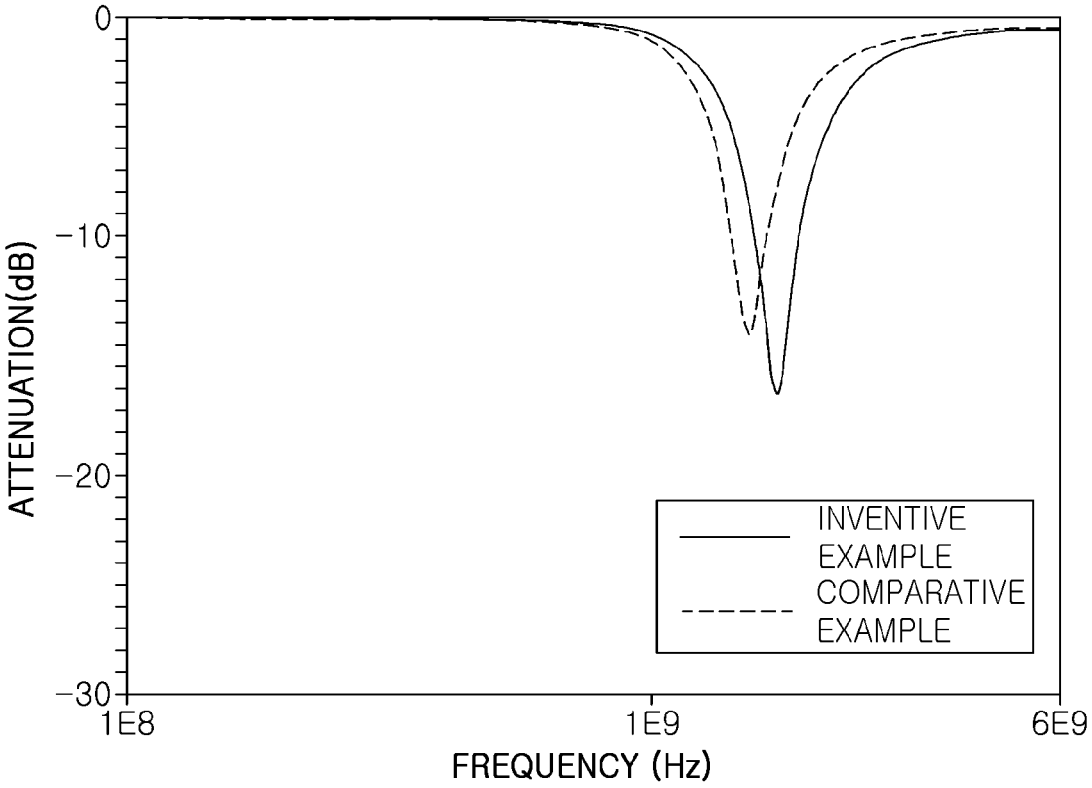
FIG. 3 is a graph showing a self-resonance frequency and a noise attenuation rate of the laminated inductor according to the embodiment of the present invention and a laminated inductor according to the related art.

In addition, as shown in FIG. 3, the respective internal conductive patterns 121, 122, and 123 are laminated in a vertical direction with respect to the body 110, such that stray capacitance and capacitive coupling between the circuit boards are decreased as compared to a horizontal type laminated inductor according to the related art as a comparative example, such that a self-resonance frequency may be high, noise generated at a high frequency may be effectively removed, and filter characteristics may be improved.

In addition, a direct current resistance $R_{DC}$ value and an equivalent series resistance (ESR) value may be easily controlled according to the width, thickness, and amount of the second and third internal conductive patterns 122 and 123.

Figure 7A:
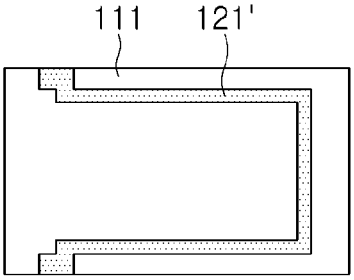
FIGS. 7A through 7C are plan views showing other examples of first to third internal conductive patterns of the laminated inductor according to the embodiment of the present invention.
Figure 7B:
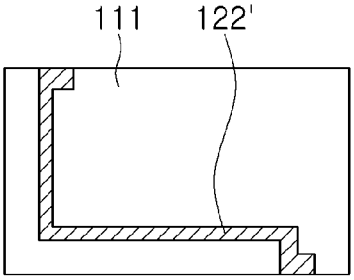
Figure 7C:
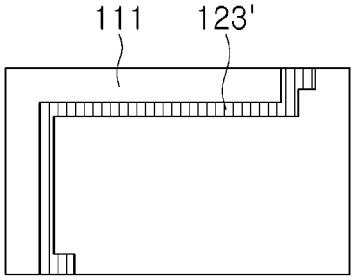
Figure 8:
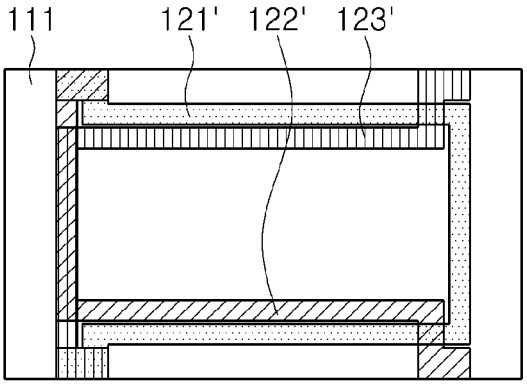
FIG. 8 is a plan view showing a state in which the first to third internal conductive patterns of FIGS. 7A through 7C are overlapped with one another.
Figure 9A:
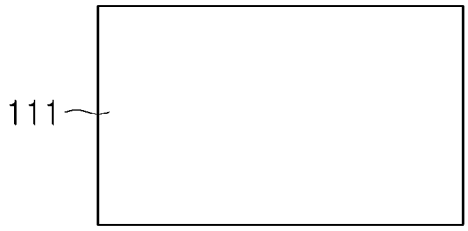
FIGS. 9A through 9J are plan views showing an example of the order of the first to third internal conductive patterns applied to the laminated inductor array of FIG. 6.
Figure 9B:
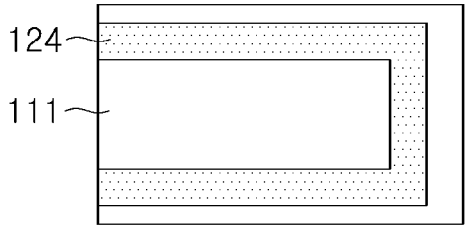
Figure 9C:
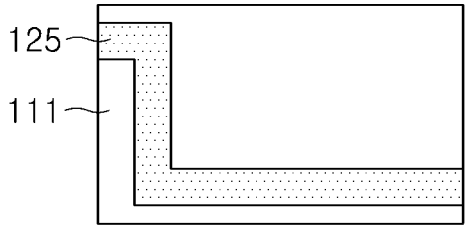
Figure 9D:
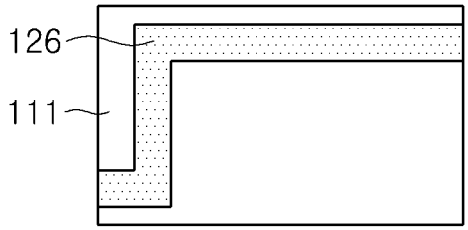
Figure 9E:
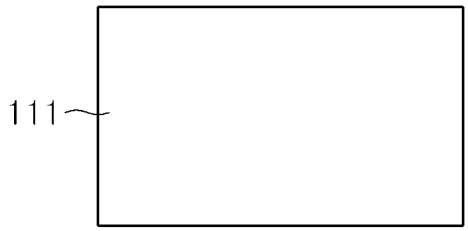
Figure 9F:
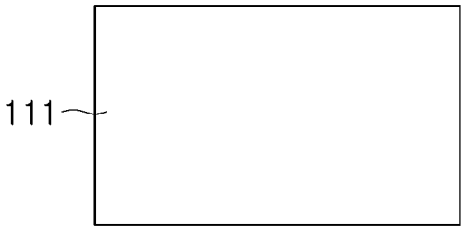
Figure 9G:
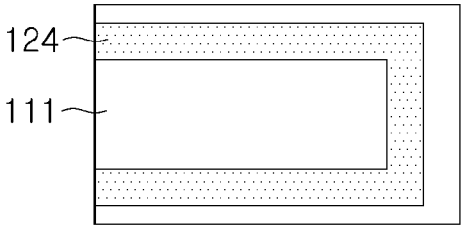
Figure 9H:
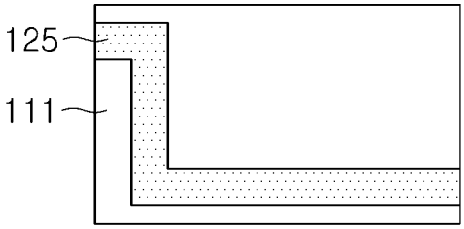
Figure 9I:
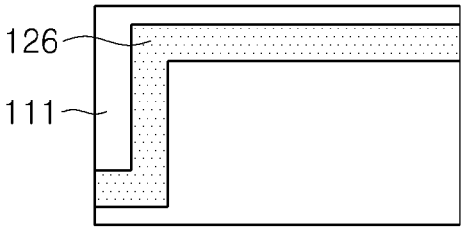
Figure 9J:
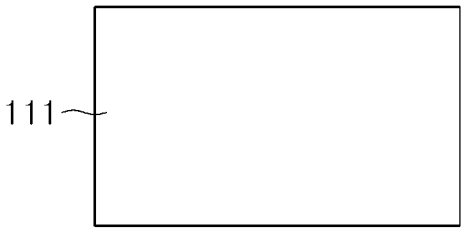

Referring to FIGS. 7 and 8, the first to third internal conductive patterns 121', 122', and 123' may be formed on the magnetic layers 111 by adjusting the width and position of the respective patterns so as not to overlap an overlap area portion between the first to third internal conductive patterns 121', 122', and 123' with one another. As described above, in the case in which the overlap area portions between the first to third internal conductive patterns 121', 122', and 123' are not overlapped with one another, the stray capacitance between the first to third internal conductive patterns 121', 122', and 123' may be further decreased and the capacitive coupling may be further decreased, such that high frequency characteristics may be further improved.

MODIFIED EXAMPLE

Figure 4:
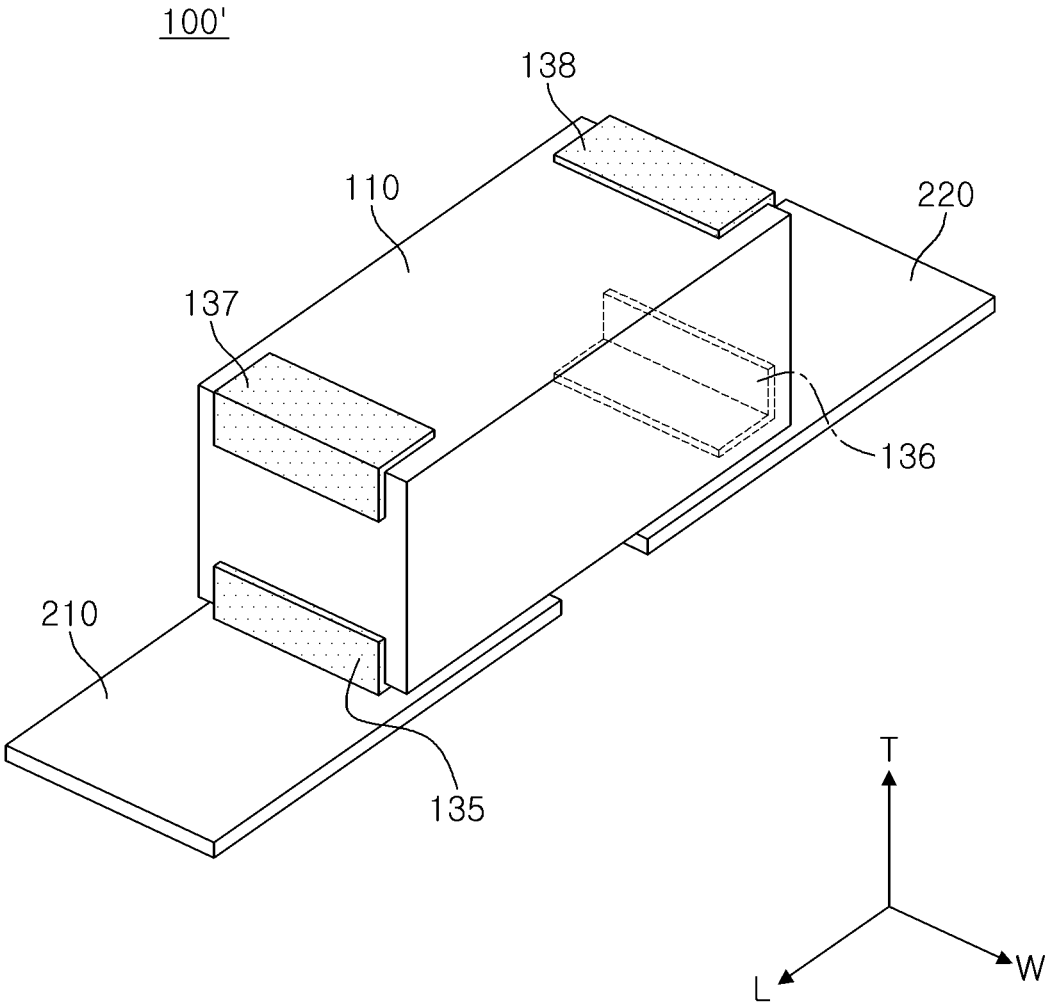
FIG. 4 is a perspective view showing a laminated inductor and a PCB according to another embodiment of the present invention.
Figure 5A:
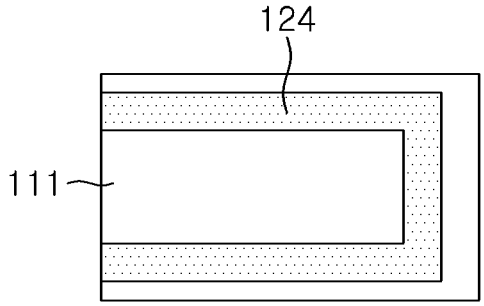
FIGS. 5A through 5C are plan views showing first to third internal conductive patterns of the laminated inductor according to another embodiment of the present invention.
Figure 5B:
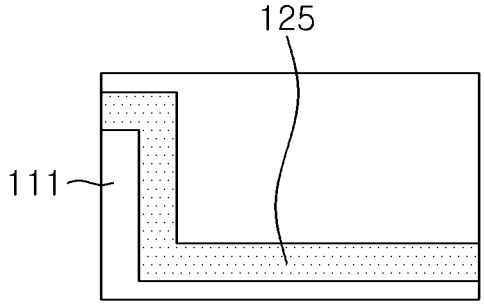
Figure 5C:
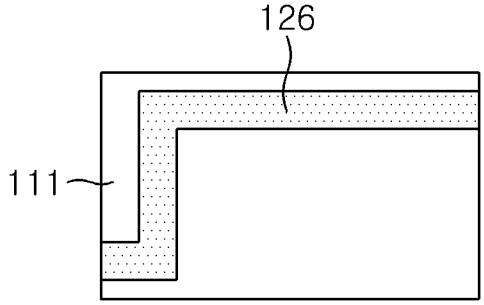

FIGS. 4 and 5 show a laminated inductor according to another embodiment of the invention.

Referring to FIGS. 4 and 5, a laminated inductor 100' according to another embodiment of the invention has a first connection electrode 137 extended from the first main surface 1 of the body 110 to the third end surface 3 thereof, a first terminal electrode 135 extended from the second main surface 2 of the body 110 to the third end surface 3 thereof and spaced apart from the first connection electrode 135, a second connection electrode 138 spaced apart from the first connection electrode 137 of the body 110 and extended from the first main surface 1 of the body 110 to the fourth end surface 4 thereof, and a second terminal electrode 136 spaced apart from the first terminal electrode 135 and extended from the second main surface 2 of the body 110 to the fourth end surface 4 thereof.

A first internal conductive pattern 124 may be configured to connect the first connection electrode 137 and the first terminal electrode 135, a second internal conductive pattern 125 may be configured to connect the first connection electrode 137 and the second terminal electrode 136, and a third internal conductive pattern 126 may be configured to connect the second connection electrode 138 and the first terminal electrode 135.

In this case, the first internal conductive pattern 124 may be formed to be extended along the upper and lower sides and the right side of the magnetic layer 111 so as to be adjacent to the first and second main surfaces 1 and 2 and the fourth end surface 4 of the body 110 so that the internal conductive pattern 124 is elongated.

That is, the first internal conductive pattern 124 may be formed to have a "⊃" shape, and both ends thereof may be electrically connected to the first connection electrode 137 and the first terminal electrode 135, respectively, by being drawn out through the left side of the magnetic layer 111.

In addition, the second internal conductive pattern 125 may be formed to be extended along the lower side and the left side of the magnetic layer 111 so as to be adjacent to the second main surface 2 and the third end surface 3 of the body 110 so that the internal conductive pattern 125 is elongated.

That is, the second internal conductive pattern 125 may be formed to have a "∟" shape, and an upper end thereof may be electrically connected to the first connection electrode 137 by being bent toward the left side of the magnetic layer 111, and a lower end thereof may be electrically connected to the second terminal electrode 136 by being drawn out through the right side of the magnetic layer 111.

In addition, the third internal conductive pattern 126 may be formed to be extended along the upper side and the left side of the magnetic layer 111 so as to be adjacent to the first main surface 1 and the third end surface 3 of the body 110 so that the internal conductive pattern 126 is elongated.

That is, the third internal conductive pattern 126 may be formed to have a "⊏" shape, and an upper end thereof may be electrically connected to the second connection electrode 138 by being drawn out through the right side of the magnetic layer 111, and a lower end thereof may be electrically connected to the first terminal electrode 135 by being bent to be drawn out through the left side of the magnetic layer 111.

Hereinafter, a detailed description of parts similar to those of the above described embodiments will be omitted to avoid an overlapped description.

Figure 6:
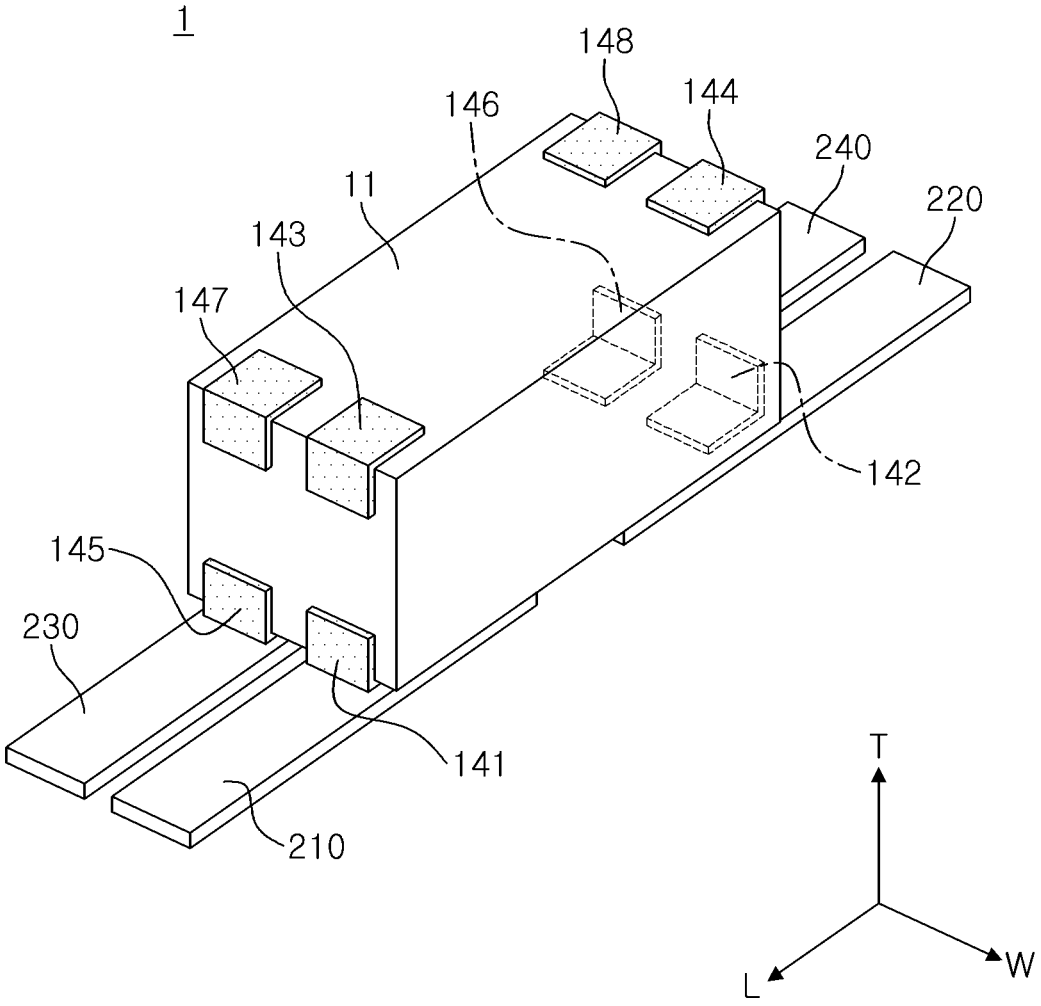
FIG. 6 is a perspective view showing a laminated inductor array and a PCB according to an embodiment of the present invention.

Meanwhile, referring to FIG. 6, the laminated inductor according to the embodiment of the invention may be configured as a laminated inductor array 1 having two circuit substrates 210, 220, 230, and 240 at left and right thereof, respectively.

The laminated inductor array 1 may have a plurality of first connection electrodes 143 and 147 extended from a first main surface 1 of a body 11 to a third end surface 3 to be spaced apart from one another, and a plurality of second connection electrodes 144 and 148 extended from the first main surface 1 of the body 11 to a fourth end surface 4 to be spaced apart from one another.

In addition, a plurality of first terminal electrodes 141 and 145 may be extended from a second main surface 2 of the body 11 to the third end surface 3 to be spaced apart from one another while being spaced apart from the first connection electrodes 143 and 147 opposing one another, and a plurality of second terminal electrodes 142 and 146 may be extended from the second main surface 2 of the body 11 to the fourth end surface 4 to be spaced apart from one another while being spaced apart from the second connection electrodes 144 and 148 opposing one another.

As shown in FIG. 6, the first and second terminal electrodes 141 and 142 positioned at a front side of the laminated inductor array 1 may be connected to the circuit substrates 210 and 220 positioned at the front side and the first and second terminal electrodes 145 and 146 positioned at a rear side of the laminated inductor array 1 may be connected to the circuit substrates 230 and 240 positioned at the rear side.

The laminated inductor array 1 configured as described above may be used as a common mode filter.

Referring to FIGS. 9A through 9J, the body 11 according to the embodiment of the invention may have the internal conductive patterns laminated in the following order.

First, at least one magnetic layer 111 on which the internal conductive pattern is not formed may be disposed as a cover layer, and the first to third internal conductive patterns 124, 125, and 126 may be disposed in front of the cover layer. Here, the first internal conductive pattern 124 may be configured to connect the first connection electrode 147 and the first terminal electrode 145, the second internal conductive pattern 125 may be configured to connect the first connection electrode 147 and the second terminal electrode 146, and the third internal conductive pattern 126 may be configured to connect the second connection electrode 148 and the first terminal electrode 145.

Next, at least one magnetic layer 111 in which the internal conductive pattern is not formed may be disposed as an intermediate gap layer, and then the first to third internal conductive patterns 124, 125, and 126 may be disposed in front of the intermediate gap layer. Here, the first internal conductive pattern 124 may be configured to connect the first connection electrode 143 and the first terminal electrode 141, the second internal conductive pattern 125 may be configured to connect the first connection electrode 143 and the second terminal electrode 142, and the third internal conductive pattern 126 may be configured to connect the second connection electrode 144 and the first terminal electrode 141.

Hereinafter, a detailed description of parts similar to those of the above described embodiments will be omitted to avoid an overlapped description.

As set forth above, according to embodiments of the invention, an inductor may have high self-resonance frequency and efficiently remove noise generated at high frequency by decreasing stray capacitance between PCBs.

In addition, when the inductor is mounted on a substrate, contact between terminal electrodes and connection electrodes or a solder bridge may be prevented, such that it is advantageous for a miniaturization of a product.

While the present invention has been shown and described in connection with the embodiments, it will be apparent to those skilled in the art that modifications and variations can be made without departing from the spirit and scope of the invention as defined by the appended claims.

What is claimed is:

1. A laminated inductor comprising:

a body having a plurality of sheets laminated in a width direction, and having first and second main surfaces opposing one another in a thickness direction, third and fourth end surfaces opposing one another in a length direction, and fifth and sixth side surfaces opposing one another in the width direction;

a first connection electrode formed on the first main surface of the body;

first and second terminal electrodes formed on the second main surface of the body to be spaced apart from one another;

a plurality of first internal conductive patterns formed on respective sheets laminated within the body and connecting the first connection electrode and the first terminal electrode;

at least one or more second internal conductive patterns formed on respective sheets laminated within the body and connecting the first connection electrode and the second terminal electrode, respectively, a second connection electrode formed on the first main surface of the body to be spaced apart from the first connection electrode; and at least one or more third internal conductive patterns formed on respective sheets laminated within the body and connecting the second connection electrode and the first terminal electrode.

2. The laminated inductor of claim 1, wherein the first and second terminal electrodes and the first and second connection electrodes are disposed to face one another in the thickness direction of the body.

3. The laminated inductor of claim 2, wherein the first internal conductive pattern is formed to be extended along sides of the sheet so as to be adjacent to the first and second main surfaces and the fourth end surface of the body.

4. The laminated inductor of claim 2, wherein the second internal conductive pattern is formed to be extended along sides of the sheet so as to be adjacent to the second main surface and the third end surface of the body, and the third internal conductive pattern is formed to be extended along sides of the sheet so as to be adjacent to the first main surface and the third end surface of the body.

5. The laminated inductor of claim 1, wherein the first and second internal conductive patterns have a constant width over the entire length thereof.

6. The laminated inductor of claim 1, wherein a direct current resistance RDC value and an equivalent series resistance (ESR) value are controlled according to width, thickness, and amount of the second internal conductive patterns.

7. The laminated inductor of claim 1, wherein the sheets are formed of a magnetic material.

8. The laminated inductor of claim 1, wherein the sheets are formed of a non-magnetic material.

9. The laminated inductor of claim 2, wherein the first to third internal conductive patterns are formed on the sheets by adjusting widths and positions of the respective patterns so as not to allow overlap area portions therebetween to be overlapped with one another.

* * * * *